United States Patent [19]

Cantrell et al.

[11] Patent Number: 4,620,557

[45] Date of Patent: Nov. 4, 1986

[54] CIGARETTE HAVING A MOUTHPIECE AND METHOD OF MAKING SAME

[75] Inventors: Daniel V. Cantrell, Prospect; Dale A. Halverstadt; David L. Gordon, both of Louisville, all of Ky.

[73] Assignee: Brown & Williamson Tobacco Corporation, Louisville, Ky.

[21] Appl. No.: 558,245

[22] Filed: Dec. 5, 1983

[51] Int. Cl.[4] ..... A24D 3/04; A24D 3/02

[52] U.S. Cl. ..... 131/336; 131/339; 493/39; 493/42; 493/43

[58] Field of Search ..... 131/336; 493/39, 40, 493/41, 42, 43

*Primary Examiner*—V. Millin

*Attorney, Agent, or Firm*—Charles G. Lamb

[57] ABSTRACT

A cigarette has a cylindrical impermeable mouthpiece located in coaxial abutment to one end of a tobacco column of the cigarette. The mouthpiece includes an annular groove in its peripheral surface and a plurality of longitudinally extending grooves formed in its peripheral surface extending from the annular groove to the mouth end of the mouthpiece. A plurality of smoke flow capillaries are formed through the mouthpiece from one end to the other. Each capillary is generally parallel to the longitudinal axis of the mouthpiece except for the portion beneath the annular groove which is curved to the longitudinal axis of the mouthpiece. A method for making the mouthpiece includes the steps of co-extruding a generally cylindrical shell of a plastic material and a core of another material filling the interior of the shell, forming an annular groove in the peripheral surface of the shell and concurrently deforming the section of each capillary located beneath the annular groove out of parallel with the longitudinal axis of the shell, and forming a plurality of longitudinal grooves in the periphery of the shell extending from the annular grooves to one end of the shell. Air permeable tipping material circumscribes the mouthpiece and overlaps a portion of the tobacco column to fasten the mouthpiece to the tobacco column.

20 Claims, 3 Drawing Figures

CIGARETTE HAVING A MOUTHPIECE AND METHOD OF MAKING SAME

BACKGROUND OF THE INVENTION

1. Field of the Invention

The present invention relates to smoke diluting devices, and more particularly to a mouthpiece for a cigarette, or the like, which reduces tar exclusively by ventilation.

2. Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering end are shown in the following Patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways, and transverse passageways interconnecting the longitudinal passageways and central passageway with each other and with the ambient air. As the cigarette to which the device is attached is smoked, smoke and ambient air traverses the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a mouthpiece for a cigarette for lowering tar virtually exclusively by ventilation. The present invention further provides a method for making the mouthpiece.

More particularly, the present invention provides a cigarette comprising a generally cylindrical tobacco column, a generally cylindrical impermeable mouthpiece having an upstream end and a mouth end, the mouthpiece being located with the upstream end in coaxial abutment with one end of the tobacco column; an annular groove formed in the peripheral surface of the mouthpiece; a plurality of longitudinal grooves formed in the peripheral surface of the mouthpiece extending generally longitudinally of the mouthpiece from the annular groove to the mouth end of the mouthpiece; a plurality of smoke flow through capillaries formed through the mouthpiece from the upstream end to the mouth end thereof, such that each capillary has an open smoke inlet at the mouthpiece upstream end and an open smoke outlet at the mouthpiece downstream end; each capillary having a first section generally parallel to the longitudinal axis of the mouthpiece extending from the upstream end of the mouthpiece to a location near the annular groove, a second section extending from the first capillary section beneath and across the width of the annular groove angled relative to the longitudinal axis of the mouthpiece, and a third section extending from the second capillary section at a location near the annular groove to the mouth end of the mouthpiece; and, air permeable tipping material circumscribing the mouthpiece and overlapping a portion of the tobacco column adjacent the mouthpiece.

The present invention further provides a method of making a generally cylindrical mouthpiece for use with a cigarette comprising the steps of coextruding a generally cylindrical shell of a first impermeable plastic material and a core of a second impermeable material filling the interior volume of the shell forming a plurality of smoke flow capillaries through the shell generally parallel to the longitudinal axis of the cylindrical shell as the shell and core are being coextruded, forming an annular groove in the peripheral surface of the shell and concurrently deforming the section of each capillary located generally beneath the annular groove out of parallel with the longitudinal axis of the shell, and forming a plurality of generally longitudinal grooves in the periphery of the shell extending from the annular groove to the mouth end of the shell.

BRIEF DESCRIPTION OF THE DRAWINGS

The various features and advantages of the present invention will become even more clear upon reference to the following description and accompanying drawings wherein like numbers refer to like parts throughout, and in which.

DESCRIPTION OF THE PREFERRED EMBODIMENT

Figure 1:
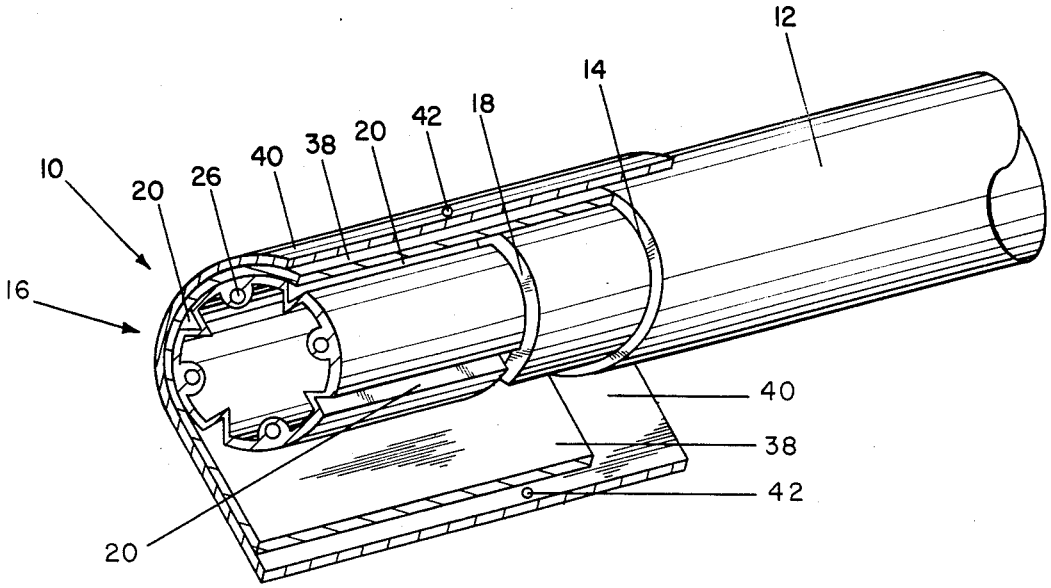
FIG. 1 is a perspective view of a cigarette of the present invention, the tipping material being shown as partially unwrapped to more clearly show details.

FIG. 1 illustrates a mouthpiece, generally denoted as the number 10, attached to a generally cylindrical tobacco column 12. The mouthpiece 10 is impermeable and has an upstream end 14 and mouth end 16. The mouthpiece is situated with the upstream end 14 in coaxial abutment with one end of the tobacco column 12.

Figure 2:
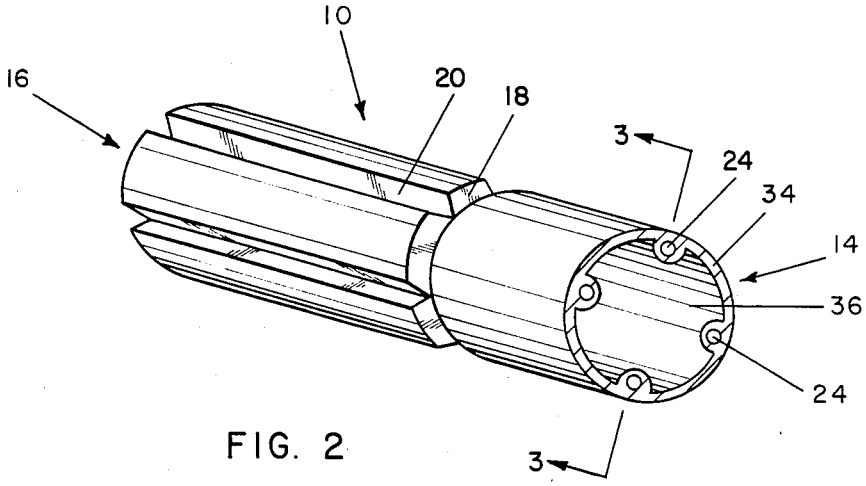
FIG. 2 is a perspective view of the mouthpiece of FIG. 1.
Figure 3:
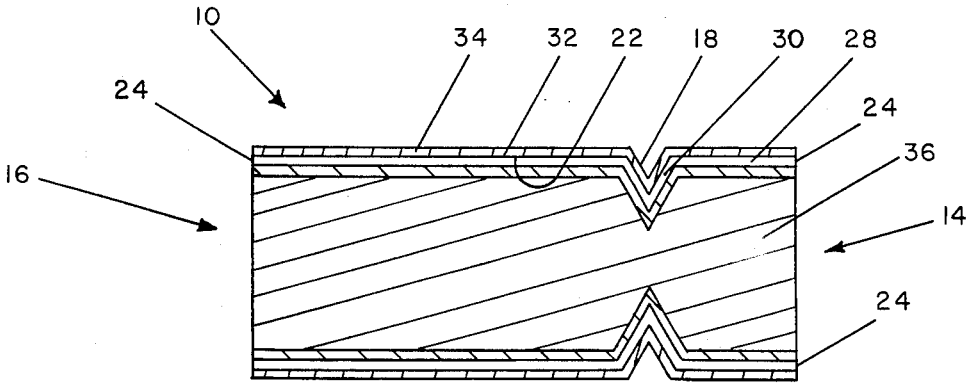
FIG. 3 is a longitudinal cross-sectional view of the mouthpiece of FIG. 1 as seen in the direction of arrows 3—3 in FIG. 2.

With continued reference to FIG. 1 and additional reference to FIGS. 2 and 3, the mouthpiece 10 includes an annular groove 18 formed in its peripheral surface, and a plurality of generally longitudinal grooves 20 formed in its peripheral surface extending from the annular groove 18 to the mouth end 16 of the mouthpiece 10. Each of the grooves 20 is in open flow communication with the annular groove 18 and open to the mouth end 16 of the mouthpiece 10. A plurality of smoke flow capillaries 22 are formed through the mouthpiece 10 from the upstream end 14 to the mouth end 16 such that each capillary has an open smoke inlet 24 at the mouthpiece upstream end 14 and an open smoke outlet 26 at the mouth end 16 of the mouthpiece 10.

As can be best seen in FIG. 3, each smoke flow capillary 22 has three flow sections. The first flow section 28 is generally parallel to the longitudinal axis of the mouthpiece 10 extending from the upstream end 14 of the mouthpiece 10 to a location near the annular groove 18. The second flow section 30 extends from the downstream end of the first flow section 28 beneath and across the width of the annular groove 18 and is bent or angled relative to the longitudinal axis of the mouthpiece 10. The third flow section 32 extends from the downstream end of the second flow section 30 at a location near the annular groove 18 to the mouth end 16 of the mouthpiece 10. As shown, the second flow section 30 generally conforms to the transverse cross-sectional contour of the annular groove 18, that is a curve concavely facing toward the annular groove 18. It is contemplated that the second flow section 30 need not necessarily be a smooth curve, but may be chevron in shape with a sharp apex. Further, the first and third flow sections 28 and 32 are generally coaxial.

With continued reference to FIGS. 1–3, the longitudinal grooves 20 are generally equally spaced apart about the circumference of the mouthpiece 10 and the open outlets 26 of the capillaries 22 are generally equally spaced apart circumambiently of the mouth end 16 of the mouthpiece 10. As shown, the number of longitudinal grooves 20 is equal to the number of capillaries 22, and the open outlets 26 of the capillaries 22 are displaced from the open ends of the longitudinal grooves 20 at the mouth end 16 of the mouthpiece 10 circumferentially of the mouthpiece 10. While, by way example, four smoke flow capillaries 22 and four longitudinal grooves 20 are illustrated in FIGS. 1–3, the number of smoke capillaries 22 does not necessarily have to be equal to the number of longitudinal grooves 20. Further, it has been found that advantageous results are obtained using from three to seven smoke capillaries 22. In addition, it has been determined that the cross-sectional area of each smoke capillary 22 should be on the order of from about 0.00125 $cm^2$ to about 0.00385 $cm^2$. Still further, a total ventilating air to smoke flow ratio of about 3 to 1.

As can be best visualized with reference to FIGS. 2 and 3, the mouthpiece 10 is constructed of a generally cylindrical shell 34 fabricated of an impermeable material, and an impermeable core 36 filling the interior volume of the shell 34. The capillaries 22 are defined in the shell 34 of the mouthpiece 10. The impermeable shell material can be, for example, cellulose acetate or polyethylene plastic, and the impermeable core material can be, for example, cellulose acetate or polyethylene plastic.

With reference to FIG. 1, a layer of permeable wrap 38 circumscribes the mouthpiece 10. The mouthpiece 10 is shown as being attached to the tobacco column 12 by an air permeable tipping material 40 which circumscribes the mouthpiece 10, overlaying the permeable wrap 38, and overlapping a portion of the tobacco column 12 adjacent the upstream end 14 of the mouthpiece 10. At least a portion of the tipping material 40 surrounding the mouthpiece 10 is air permeable over at least a portion of the annular groove 18. The tipping material 40 may also be air permeable over at least a portion of each of the longitudinal grooves 20 as well. The tipping material 40 can be fabricated of a porous material or, as shown, the air permeability can be provided by forming small perforations 42 through the thickness of the otherwise air impermeable tipping material 40. The mouth end 16 of the mouthpiece 10 can be recessed by any number of methods, for example, by extending the tipping material 40 beyond the mouth end 16.

The generally cylindrical mouthpiece 10 is produced by coextruding the generally cylindrical shell 34 of an impermeable material such as, for example, polyethylene plastic, and the core 36 of an impermeable material such as, for example, a closed cell cellulose acetate, filling the interior volume of the shell 34. The method includes forming the capillaries 22 through the impermeable shell 34 generally parallel to the longitudinal axis of the shell 34 concurrently with the coextruding of the shell 34 and core 36. After the shell 34 and core 36 have been coextruded, the annular groove 18 and longitudinal grooves 20 are formed in the peripheral surface of the shell 34. Preferrably, the annular groove 18 and longitudinal grooves 20 are formed by deforming selected portions of the shell 34 inwardly of the shell 34 toward the core 36. As the annular groove 18 is being formed by deforming the shell 34, the length of each capillary 22 in the zone of the shell 34 being deformed to form the annular groove 18 is also deformed or bent out of parallel to the longitudinal axis of the shell 34 to form the second flow section 30 in each capillary 22. Thus, the second capillary flow sections 30 are bent into a curve concavely facing the annular groove 18 which generally conforms to the transverse cross-sectional contour of the annular groove 18. Further, the selected portions of the shell 34 deformed to define the longitudinal grooves 20 are between adjacent capillaries 22. Preferrably, the steps of forming the annular groove 18 and longitudinal grooves 20 are performed concurrently.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A cigarette comprising:

a generally cylindrical tobacco column;

a generally cylindrical impermeable mouthpiece having an upstream end and a mouth end, the mouthpiece being located with the upstream end in coaxial abutment with one end of the tobacco column;

an annular groove formed in the peripheral surface of the mouthpiece;

a plurality of longitudinal grooves formed in the peripheral surface of the mouthpiece extending generally longitudinally of the mouthpiece from the annular groove to the mouth end of the mouthpiece;

a plurality of smoke flow capillaries formed through the mouthpiece from the upstream end to the mouth end thereof such that each capillary has an open smoke inlet at the mouthpiece upstream end and an open smoke outlet at the mouth end of the mouthpiece;

each capillary having a first flow section generally parallel to the longitudinal axis of the mouthpiece extending from the upstream end of the mouthpiece to a location near the annular groove, a second flow section extending from the first capillary section beneath and across the width of the annular groove angled relative to the longitudinal axis of the mouthpiece, and a third flow section extending from the second capillary section at a location near the annular groove to the mouth end of the mouthpiece; and, air permeable tipping material circumscribing the mouthpiece and overlapping a portion of the tobacco column adjacent the mouthpiece.

2. The cigarette of claim 1, wherein the first and third flow sections of each capillary are generally coaxially aligned.

3. The cigarette of claim 1, wherein the second flow section of each capillary is generally bent into a curve concavely facing toward the annular groove.

4. The cigarette of claim 3, wherein the curved second section of each capillary generally conforms to the transverse cross-sectional contour of the annular groove.

5. The cigarette of claim 1, wherein the number of longitudinal grooves is equal to the number of capillaries.

6. The cigarette of claim 1, wherein:

the grooves are generally equally spaced circumambiently of the mouthpiece; and, the open outlets of the capillaries are generally equally spaced apart circumambiently at the mouth end of the mouthpiece.

7. The cigarette of claim 6, wherein the open outlets of the capillaries are displaced from the open ends of the longitudinal grooves at the mouth end of the mouthpiece circumferentially of the mouthpiece.

8. The cigarette of claim 1, further comprising a porous wrap material circumferentially surrounding the mouthpiece beneath the tipping material.

9. The cigarette of claim 1, wherein the tipping material is air permeable over at least a portion of the annular groove.

10. The cigarette of claim 1, wherein the tipping material is air permeable over at least a portion of the annular groove and over at least a portion of each of the longitudinal grooves.

11. The cigarette of claim 1, wherein the mouthpiece further comprises:

a polyethylene, generally cylindrical shell; and, an impermeable cellulose acetate core filling the interior volume of the shell.

12. The cigarette of claim 11, wherein the capillaries are formed in the cylindrical shell.

13. A method of making a generally cylindrical mouthpiece for use with a cigarette comprising the steps of:

coextruding a generally cylindrical shell of a first impermeable plastic material and a core of a second impermeable material filling the interior volume of the shell;

forming a plurality of smoke flow capillaries through the shell generally parallel to the longitudinal axis of the cylindrical shell as the shell and core are being coextruded;

forming an annular groove in the peripheral surface of the shell and concurrently deforming the section of each capillary located generally beneath the annular groove out of parallel with the longitudinal axis of the shell; and, forming a plurality of generally longitudinal grooves in the periphery of the shell extending from the annular groove to one end of the shell.

14. The method of claim 13, wherein the step of forming the annular groove comprises deforming a portion of the shell inwardly.

15. The method of claim 13, wherein the step of forming the plurality of longitudinal grooves comprises deforming portions of the shell inwardly.

16. The method of claim 13, wherein the steps of forming the annular groove and forming the longitudinal grooves are performed after the coextrusion of the shell and core.

17. The method of claim 16, wherein the steps of forming the annular groove and forming the longitudinal grooves are concurrently performed.

18. The method of claim 16, wherein the steps of forming the annular groove and longitudinal grooves comprise deforming portions of the shell inwardly.

19. The method of claim 13, wherein the step of forming the longitudinal grooves in the shell comprises deforming a selected portion of the shell between adjacent capillaries.

20. The method of claim 13, wherein:

the shell is formed of polyethylene; and, the core is formed of a closed cell foam material.

* * * * *